US007748444B2

(12) United States Patent
Scott et al.

(10) Patent No.: US 7,748,444 B2
(45) Date of Patent: Jul. 6, 2010

(54) METHOD AND APPARATUS FOR CONNECTING, INSTALLING, AND RETRIEVING A COILED TUBING-CONVEYED ELECTRICAL SUBMERSIBLE PUMP

(75) Inventors: Brian Scott, Aberdeen (GB); David B. Pye, Pickering (GB); Joseph A. Nicholson, Broughton-in-Furness Cumbria (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 253 days.

(21) Appl. No.: 11/768,088

(22) Filed: Jun. 25, 2007

(65) Prior Publication Data

US 2008/0210441 A1 Sep. 4, 2008

Related U.S. Application Data

(60) Provisional application No. 60/892,737, filed on Mar. 2, 2007.

(51) Int. Cl.
*E21B 43/00* (2006.01)
*E21B 19/22* (2006.01)

(52) U.S. Cl. ..... 166/65.1; 165/77.1; 165/77.2; 165/75.14; 165/75.11

(58) Field of Classification Search ..... 166/65.1, 166/77.1, 77.2, 75.14, 75.11
See application file for complete search history.

(56) References Cited

U.S. PATENT DOCUMENTS

| | | | | |
|---|---|---|---|---|
| 5,052,941 | A | 10/1991 | Hernandez-Marti | |
| 6,145,597 | A | 11/2000 | Kobylinski | |
| 6,298,921 | B1 | 10/2001 | Kobylinski | |
| 6,328,111 | B1 | 12/2001 | Bearden | |
| 6,332,499 | B1 | 12/2001 | Kobylinski | |
| 6,719,061 | B2 | 4/2004 | Muller | |
| 6,776,230 | B2 * | 8/2004 | Collie et al. | 166/97.1 |
| 6,989,764 | B2 | 1/2006 | Thomeer | |
| 2002/0070030 | A1 | 6/2002 | Smith | |
| 2007/0142547 | A1 | 6/2007 | Vaidya | |

FOREIGN PATENT DOCUMENTS

| | | | |
|---|---|---|---|
| EP | 1094194 | A2 | 4/2001 |
| EP | 1094194 | A3 | 4/2001 |
| GB | 2062368 | A | 5/1981 |
| GB | 2359317 | A | 8/2001 |
| GB | 2361726 | A | 10/2001 |
| GB | 2370427 | A | 6/2002 |

* cited by examiner

*Primary Examiner*—David J Bagnell
*Assistant Examiner*—Yong-Suk Ro
(74) *Attorney, Agent, or Firm*—Rodney V. Warfford; Kevin B. McGoff; Winstead Sechrest & Minick

(57) ABSTRACT

A wellhead system has a wellhead of a subterranean hydrocarbon well, a coiled tubing hanger in the wellhead, a coiled tubing hanger extension connected to a top portion of the coiled tubing hanger, a first seal inside the coiled tubing hanger extension, the first seal and the coiled tubing hanger extension defining a sealed space in the coiled tubing hanger extension. Coiled tubing extends into the sealed space in the coiled tubing hanger extension and being suspended by the coiled tubing hanger and the coiled tubing hanger extension, the coiled tubing extending into the wellhead. A downhole electrical cable extends through the coiled tubing and into the sealed space in the coiled tubing hanger extension. An electrical connector extends through the seal and is connected electrically to the cable. The electrical connector has an electrical circuit having an electrically open and an electrically closed position.

15 Claims, 2 Drawing Sheets

METHOD AND APPARATUS FOR CONNECTING, INSTALLING, AND RETRIEVING A COILED TUBING-CONVEYED ELECTRICAL SUBMERSIBLE PUMP

CROSS REFERENCE TO RELATED APPLICATION

The present application is based on and claims the benefit of priority under 35 U.S.C. §119 to U.S. Provisional Patent Application Ser. No. 60/892,737, entitled, "Method and Apparatus for a Connecting, Installing, and Retrieving a Coiled Tubing-Conveyed Electrical Submersible Pump," filed on Mar. 2, 2007.

TECHNICAL FIELD

The present invention relates generally to the field of downhole fluid transfer, and more specifically to submersible and surface pump apparatus and systems and methods of making and using same.

BACKGROUND

In oil wells that are produced with the use of Electrical Submersible Pumps (ESPs), coiled tubing may be used to deploy the ESP. In some instances, the ESP power cable will be contained within the coiled tubing. Installation and retrieval of the coiled tubing and ESP requires access to the electrical cable in the coiled tubing, i.e., extending from the open end of the coiled tubing, in order to connect or disconnect the power cable. In the event of a failure of the coiled tubing, resulting in pressurized fluids inside the coiled tubing, that access would be compromised, and the system integrity as a whole would be compromised. Therefore, it may be beneficial to augment the coiled tubing deployed ESP system to allow for a connection and disconnection of the power cable from a position external to the area exposed to pressure within the coiled tubing.

SUMMARY

According to an embodiment that relates to solutions to the issues noted above, the present application describes a wellhead system, specifically a wellhead coiled tubing system. The wellhead coiled tubing system comprises a wellhead of a subterranean hydrocarbon well; a coiled tubing hanger in the wellhead; a coiled tubing hanger extension connected to a top portion of the coiled tubing hanger; a first seal inside the coiled tubing hanger extension, the first seal and the coiled tubing hanger extension defining a sealed space in the coiled tubing hanger extension; coiled tubing extending into the sealed space in the coiled tubing hanger extension and being suspended by the coiled tubing hanger and coiled tubing hanger extension, the coiled tubing extending into the wellhead; a downhole electrical cable extending through the coiled tubing and into the sealed space in the coiled tubing hanger extension; an electrical connector extending through the seal and being connected electrically to the cable, the electrical connector having an electrical circuit having an electrically open and an electrically closed position, one side of the electrical circuit being electrically connected to an uphole electrical cable and another side of the electrical circuit being electrically connected to the downhole electrical cable.

In no way is that embodiment meant to be limiting on the scope of the claims that are recited herein.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via another element" and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

In the written description and appended claims, the term "coiled tubing" may be interpreted to mean any downhole tubing that is capable of serving as a conduit for downhole fluids from downhole to uphole and for conveying downhole tools, and/or has any other attributes that are known to be associated with coiled tubing.

In some embodiments of the present invention, a device to seal, support, connect and install a coiled tubing deployed ESP in a wellhead is provided. According to some embodiments, the device is able to support the combined weight of an ESP, coiled tubing, cable, and other pump system components, to provide containment for an additional length of cable to accommodate any helical winding of the power cable inside the coiled tubing, to provide a pressure barrier to the inside of the coiled tubing, to provide a pressure barrier to the outside of the coiled tubing within a wellhead, to provide an electrical connection (a circuit) that can be operated, and be capable of being installed and removed from the wellhead, either manually or by the use of releasable service tools.

Figure 1:
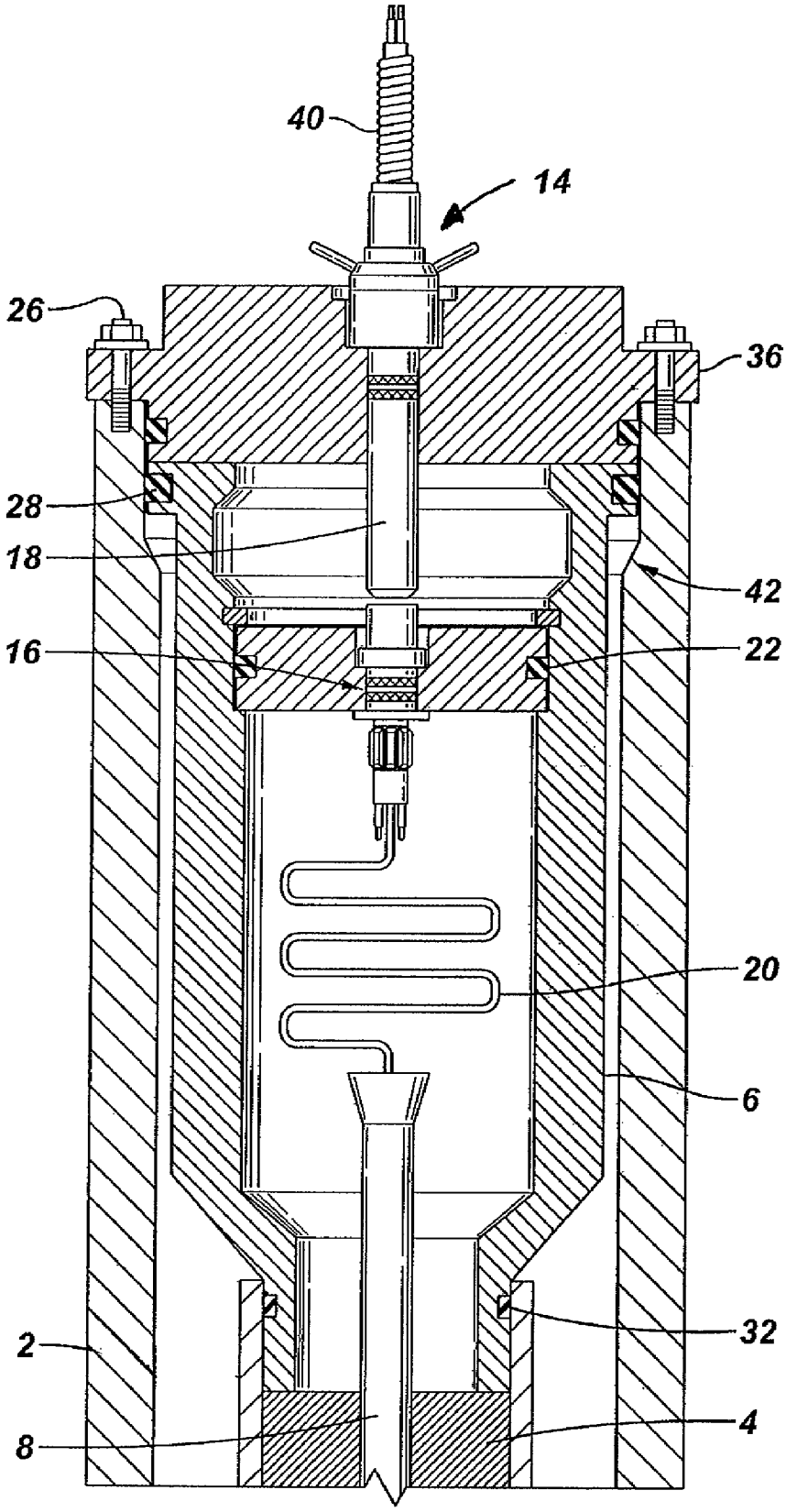
FIG. 1 shows a wellhead device according to an embodiment described herein.

With reference to FIG. 1, some embodiments of the present invention include a wellhead device. A wellhead 2 is a top portion of a casing string that extends into a subterranean hydrocarbon wellbore, thereby lining the wellbore. The wellhead 2 can extend out of the wellbore. Coiled tubing 8 is extended downhole inside the wellhead 2. A coiled tubing hanger 4 is provided to support the weight of the coiled tubing 8 when extending downhole. The hanger 4 can connect to the coiled tubing 8, and can in turn be secured to the wellhead 2 to support the weight of the coiled tubing 8. A hanger extension 6 can be connected to the uphole end of the hanger 4 and can include seals 32 to ensure a pressure tight connection for the purposes of downhole operation. A single hanger part can be used instead of hanger 4 and hanger extension 6. The hanger extension 6 can be connected to the inside of the wellhead 2. One way to connect the hanger extension 6 to the wellhead 2 is by way of ridges 42 on the inside of the wellhead 2. Additionally, seals 28 can be used to ensure a pressure tight seal for the purposes of downhole operation. That configuration supports the weight of the coiled tubing 8 by way of the hanger 4, the hanger extension 6, and the wellhead 2.

As shown in FIG. 1, the coiled tubing 8 opens up into a space within the hanger extension 6. An electric cable 20 is provided within the coiled tubing 8. The electric cable is capable of carrying an electricity downhole to a tool (not shown) that is attached to the downhole end of the coiled tubing 8, e.g., an electric submersible pump.

As noted earlier, one issue is the potential failure of the device resulting in downhole fluid being ejected from inside the coiled tubing into the space inside the hanger extension 6. Thus, a seal 22 is provided inside the hanger extension 6 that prevents pressurized fluids from traveling up through the coiled tubing 8, into the space inside the hanger extension 6, and into other areas that can prove dangerous for operators. Also, a seal 36 can be used to provide added security. The seal 36 can be fastened to the top of the wellhead 2, the top of the hanger extension 6, or a combination thereof. The seal 36 can be fastened by any suitable means, including welding, latching, clamping or bolting, to name but a few. FIG. 1 shows the use of bolts 26 connected through the seal 36 and into the wellhead 2.

Figure 2:
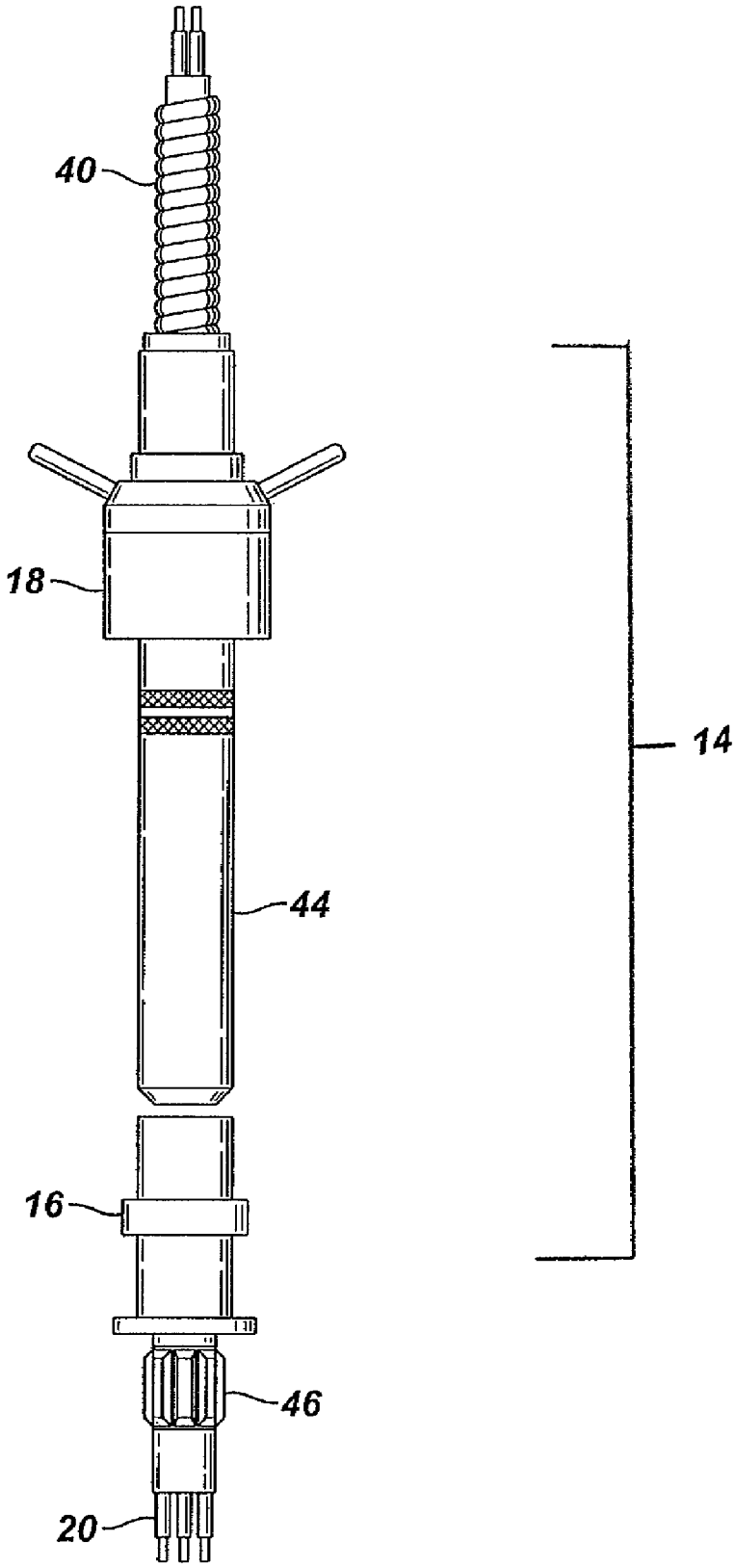
FIG. 2 shows an electrical connector.

The seal 22 is provided with an opening through which an electrical connector 14 is provided. The connector 14 comprises two parts, part 16 and part 18. The connector 14 is constructed so as to create an electrical circuit with an open position and a closed position. In the open position the part 16 is separated from the part 18 enough so that electric current will not flow from the part 18 to the part 16 sufficiently to drive a downhole tool. In the closed position the part 16 is close enough (preferably in physical contact) to the part 18 so that electricity will flow from the part 18 to the part 16 sufficiently to drive a downhole tool. The part 16 of the connector 14 is connected through the seal 22 in such a manner to maintain a pressure seal during well operations. The cable 20 is preferably electrically connected to the part 16 of the connector 14. Also, the part 18 of the connector 14 is preferably connected to an external electrical supply via a cable 40. The connector 14 is operated by rotating the part 18, which extends through a seal 36, so that the part 18 contacts part 16 so as to be electrically conductive. Tongue and groove screw elements can provide the action to the part 18 to raise and lower. It should be appreciated that there are many configurations of the connector 14 that are suitable. Some of those are of a switch variety, a circuit breaker variety, a push button variety, etc. Also, any manual or remotely operated opening/closing of the electrical connection is included as embodiments of the present invention. The embodiment shown in FIG. 1 is a Dry-Mate Connector and is available from Diamould Limited, which is a subsidiary of Schlumberger Technology Corporation. A detailed drawing of such a connector is shown in FIG. 2. There, the first part 18 comprises a plug 44 which is adjacent to the second part 16. The cable 40 connects to the first part 18 and the cable 20 connects to the second part 16. A dry-mate plug 46 is provided to aid in sealing the device.

It should be noted that it is not necessary to provide a seal 36, and that any structure that can adequately support the connector 14 can be used. Further, no structure is required, depending on the configuration of the connector 14, e.g., if the connector 14 is a single part, as long as the seal 22 is provided.

An open space between the seal 22 and the seal 36 is shown in FIG. 1 and, though not necessary, can be quite advantageous as far as assembly is concerned. For example, when the seal 36 is not in place, a tool can be used to connect inside the space thereby supporting the device by way of the hanger extension 6. The tool can be used to place the hanger device inside the wellhead 2, and conversely, to remove such from the wellhead 2.

The seal 22 can be manufactured from many different and equally suitable materials, e.g., metals and elastomer materials that are recognized in the art as being applicable in connection with oilfield device. Similarly, the seal 36 can be made and applied according to general knowledge in the art.

The device is capable of being assembled in many ways. Generally, the device is assembled by connecting a downhole device to an end of the coiled tubing 8. The downhole device and the coiled tubing are then fed into the wellbore. Once at a predetermined level downhole, the end of the coiled tubing is connected to a hanger 4, and perhaps a hanger extension 6. Alternately, a single hanger device can be used. The hanger is then connected within the wellhead 2 to support the weight of the coiled tubing 8 and associated downhole device. At some point the electrical cable 20 is connected to the connector 14 which extends through the seal 36 and the seal 22 is secured in place. According to FIG. 1 herein, the first part 18 of the connector 14 is appropriately positioned to function with the second part 16 of the connector 14, so as to provide electricity downhole.

While the invention has been disclosed with respect to a limited number of embodiments, those skilled in the art will appreciate numerous modifications and variations there from. It is intended that the appended claims cover such modifications and variations as fall within the true spirit and scope of the invention.

What is claimed is:

1. A wellhead system, comprising:

a wellhead of a subterranean hydrocarbon well;

a coiled tubing hanger in the wellhead;

a coiled tubing hanger extension connected to a top portion of the coiled tubing hanger;

a first seal inside the coiled tubing hanger extension, the first seal and the coiled tubing hanger extension defining a sealed space in the coiled tubing hanger extension;

coiled tubing extending into the sealed space in the coiled tubing hanger extension and being suspended by the coiled tubing hanger and the coiled tubing hanger extension, the coiled tubing extending into the wellhead;

a downhole electrical cable extending through the coiled tubing and into the sealed space in the coiled tubing hanger extension;

an electrical connector extending through the seal and being connected electrically to the cable, the electrical connector having an electrical circuit having an electrically open and an electrically closed position, one side of the electrical circuit being electrically connected to an uphole electrical cable and another side of the electrical circuit being electrically connected to the downhole electrical cable.

2. The wellhead system of claim 1, comprising a second seal that seals the top of the coiled tubing hanger extension, thereby forming an open area between the first seal and the second seal, the open area being within the coiled tubing hanger extension.

3. The wellhead system of claim 1, comprising a second seal that seals the top of the wellhead and the top of the coiled tubing hanger extension, thereby forming an open space between the second seal and the first seal, the open space between the first seal and the second seal being within the coiled tubing hanger extension.

4. The wellhead system of claim 1, wherein the electrical circuit in the electrical connector is manually opened and manually closed.

5. The wellhead system of claim 1, wherein the electrical circuit in the electrical connector is manually opened and manually closed, by rotation of a part of the electrical connector.

6. The wellhead system of claim 1, wherein a top end of the coiled tubing has an opening and the opening is inside the sealed space within the coiled tubing hanger extension.

7. The wellhead system of claim 1, wherein a second seal is fastened to the top of the wellhead thereby covering and sealing the wellhead.

8. The wellhead system of claim 1, wherein an electrical submersible pump is connected to a downhole end of the coiled tubing and is electrically connected to the downhole electrical cable.

9. The wellhead system of claim 1, wherein the electrical circuit is manually opened and manually closed.

10. The coiled tubing hanger device of claim 9, wherein the electrical circuit is manually opened and manually closed by rotating a part of the electrical connector.

11. A wellhead assembly, comprising:

a wellhead;

a coiled tubing hanger;

a seal connected inside of the coiled tubing hanger defining a sealed space inside of the coiled tubing hanger;

coiled tubing suspended from the coiled tubing hanger and extending into the sealed space inside the coiled tubing hanger;

a downhole electrical cable extending from inside the coiled tubing into the sealed space inside of the coiled tubing hanger; and an electrical connector extending through the seal into the sealed space, wherein the electrical connector is connected to the downhole electrical cable in the sealed space.

12. The wellhead assembly of claim 11, wherein the electrical connector comprises a circuit having an electrically open position and an electrically closed position.

13. The wellhead assembly of claim 12, wherein the electrical circuit is alternately opened and closed by operation of a part of the electrical connector that is external to the sealed space inside of the coiled tubing hanger.

14. The wellhead assembly of claim 12, wherein the circuit is opened and closed by rotating a part of the connector.

15. The wellhead assembly of claim 11, wherein the electrical connector is connected to an external power source.

* * * * *